US007555839B2

(12) United States Patent
Koelewyn

(10) Patent No.: US 7,555,839 B2
(45) Date of Patent: Jul. 7, 2009

(54) FISHING KNIFE

(75) Inventor: Robert W. Koelewyn, Fairfield, CT (US)

(73) Assignee: ZeeBaas LLC, Southport, CT (US)

( * ) Notice: Subject to any disclaimer, the term of this patent is extended or adjusted under 35 U.S.C. 154(b) by 0 days.

(21) Appl. No.: 11/357,829

(22) Filed: Feb. 16, 2006

(65) Prior Publication Data

US 2007/0186420 A1 Aug. 16, 2007

(51) Int. Cl.
*B26B 1/04* (2006.01)

(52) U.S. Cl. ..... 30/160; 30/159

(58) Field of Classification Search ..... D8/99; 30/155, 158, 159, 160, 161
See application file for complete search history.

(56) References Cited

U.S. PATENT DOCUMENTS

| | | | | | |
|---|---|---|---|---|---|
| 303,855 | A * | 8/1884 | Hunt | 30/155 |
| 1,701,027 | A * | 2/1929 | Brown | 30/159 |
| 2,523,575 | A * | 9/1950 | Kassel | 30/156 |
| 3,839,788 | A * | 10/1974 | Addis | 30/287 |
| 4,133,106 | A * | 1/1979 | Addis | 30/160 |
| 4,750,267 | A * | 6/1988 | Boyd | 30/161 |
| 4,776,094 | A * | 10/1988 | Glesser | 30/160 |
| 5,293,690 | A * | 3/1994 | Cassady | 30/161 |
| 5,666,732 | A * | 9/1997 | Shea | 30/329 |
| 5,794,346 | A * | 8/1998 | Seber et al. | 30/161 |
| 5,815,927 | A * | 10/1998 | Collins | 30/161 |
| 5,822,866 | A * | 10/1998 | Pardue | 30/161 |
| 6,651,344 | B2 * | 11/2003 | Cheng | 30/159 |
| 6,715,209 | B2 * | 4/2004 | Taylor et al. | 30/155 |
| D523,317 | S | 6/2006 | Ryan et al. | D8/99 |
| D557,082 | S | 12/2007 | Koelewyn | D7/649 |
| 2003/0213133 | A1 * | 11/2003 | Hanna | 30/155 |
| 2005/0097754 | A1 * | 5/2005 | Onion | 30/159 |
| 2005/0132576 | A1 * | 6/2005 | Onion | 30/158 |

* cited by examiner

*Primary Examiner*—Hwei-Siu C Payer
(74) *Attorney, Agent, or Firm*—Ware, Fressola, Van Der Sluys & Adolphson LLP

(57) ABSTRACT

A fishing knife has a handle defining a blade slot and a blade pivotally mounted between open and closed positions on a pivot pin extending through the handle. The blade has a tip, a sharp edge and back. A line cutter including a recess is defined in the blade back and a line cutting edge extends across the recess. The recess is disposed away from the tip of the blade. The line cutter is a replaceable cutter insert received in a matingly configured slot defined by the blade. The handle defines a recess cooperatively that exposes the line cutting edge when the blade is closed. The blade defines an arcuate pivot slot having enlarged lock openings at each end. A spring biased blade lock plunger extends through the pivot slot, and has a lock portion that fits in the lock openings to secure the blade in closed and open positions. The plunger is axially shiftable to position a release portion in the pivot slot, permitting the blade to pivot.

14 Claims, 5 Drawing Sheets

FISHING KNIFE

FIELD OF THE INVENTION

The invention herein relates to a knife, especially a knife well-adapted for use while fishing.

BACKGROUND OF THE INVENTION

A knife for fishing should be capable of performing many functions. In the course of fishing, it may be used to cut bait, to perform the cuts necessary to remove hooks from fish, and to gut or clean fish. The fishing knife is also used in rigging tackle, including cutting lines. The fishing knife should also perform the general functions of a knife in a boating or shore setting.

Accordingly, a fishing knife should be sturdy and be able to withstand a harsh environment. It should be easy to open and close but should lock sturdily in the open position.

One further function of a fishing knife is for cutting line in emergency situations, such as if the line has become fouled and threatens to drag expensive rods and reels overboard, or if there is a need to cut loose a fish.

SUMMARY OF THE INVENTION

A principal object of the invention herein is to provide a knife especially well-adapted for fishing.

A further object of the invention herein is to provide a fishing knife with convenient and expedient line cutting ability.

It is an additional object of the invention herein to provide a fishing knife which opens and closes easily, and is at least in part capable of one-hand operation.

It is also an object of the invention herein to provide a fishing knife that is sturdy and durable, even in harsh environments.

In carrying out the foregoing objects of the invention, a knife is provided which generally comprises a handle defining a blade-receiving slot, and a blade pivotally mounted on a pivot pin extending through the handle at one end of the blade slot, the blade being pivotal between a closed position and an open position. The handle may be provided in a first handle half and a second handle half in part secured together by the hinge pin.

According to aspects of the invention, the hinge pin extends through a first pocketed clamp received on the exterior of the first handle half. The pivot pin further extends through a pivot pin opening in the blade, and the pivot pin extends through a second apertured clamp on the exterior of the second handle half. The pivot pin is secured by a machine screw which, in cooperation with the pocketed clamp and apertured clamp, mount the blade for pivotal movement and, if the handle is provided in two handle halves, also secure the handle halves together.

In further aspects, the blade is flanked by disk-shaped polymer bearing seals, which engage the surfaces of the blade surrounding the pivot pin to both seal the pivot pin and provide a lubricious bearing surface contributing to the smooth opening and closing of the blade.

According to other aspects of the invention, the blade is held in its open and closed position by a blade lock plunger extending through the handle from the pocketed clamp, through an arcuate pivot slot in the blade and through the apertured clamp, where a distal end of the blade lock plunger is exposed for manipulation. The arcuate pivot slot in the blade has enlarged lock openings at its ends which accommodate a locking portion of the blade lock plunger. Depressing the blade lock plunger positions a smaller diameter release portion of the blade lock plunger in the pivot slot, permitting the blade to pivot from the open and closed position. The blade lock plunger is spring biased, and the bearing seals preferably have a cooperating opening accommodating the blade lock plunger.

In an additional aspect of the invention, a thumb pad is secured to a back of the blade adjacent the handle, the thumb pad extending laterally from the blade and providing a pressure pad for applying pressure to the back of the knife blade. The pressure pad may also be engaged for rotating the blade toward its open or closed position by thumb manipulation.

In a further aspect of the invention, a blade lock is slidingly mounted on the handle and engages with a notch in the back of the blade, to hold the blade securely in its open position.

In yet additional objects of the invention, the initial opening and initial closing of the blade are assisted by a spring bias. Opening and closing assist springs are mounted in an arcuate assist spring slot in the handle, and an assist pin is mounted on the blade and extends into the assist spring slot to respectively compress a respective assist spring when the blade is open and closed. Upon release of the blade by manipulation of the blade lock plunger and blade lock, the respective assist spring pivots the blade respectively from the open or closed position to initiate the opening and closing motion.

According to yet another aspect of the invention, the back of the blade has a line cutter including a line cutter recess with a line cutting edge. The line cutter recess is preferably arcuate, with the line cutting edge extending there across. The line cutter recess is preferably disposed toward the handle when the knife is in its open position, and is preferably positioned toward the tip of the blade. The line cutting edge may be provided on a replaceable cutter insert. The handle is preferably configured cooperatively with the line cutter recess such that the line cutting edge is exposed when the blade is in its closed position. The preferable handle configuration is a coincident arcuate recess. This permits the fishing knife to be used for cutting line without opening the knife and exposing the sharp edge of the blade.

Other features and objects of the invention will in part appear to those skilled in the art and will in part appear in the following detailed description and the claims, taken together with the drawings.

BRIEF DESCRIPTION OF DRAWINGS

The same reference numerals refer to the same elements throughout the various figures.

DETAILED DESCRIPTION OF PREFERRED EMBODIMENTS

Figure 1:
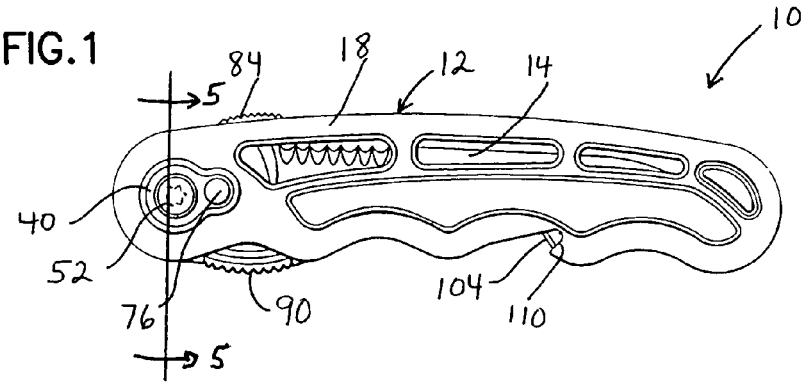
FIG. 1 is a side elevation view of a fishing knife according to the invention herein, in its closed position.
Figure 2:
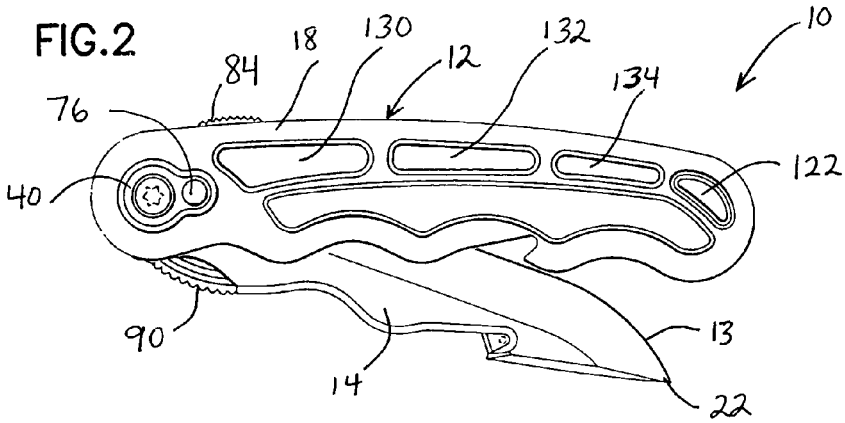
FIG. 2 is a side elevation view of the fishing knife of FIG. 1, shown in its initially opened position.

A fishing knife 10 is shown in the various figures and generally comprises a handle 12 and a blade 14. The handle 12 is provided in a first handle half 16 and a second handle half 18 that define a blade slot 20 therebetween. The blade 14 has a tip end 22, and a blade pivot end 24 having a pivot pin opening 26 therethrough.

The blade pivot end 24 is received between the respective handle pivot end 28 and handle pivot end 30 of the handle halves 16 and 18, which are also provided with pivot pin openings 32 and 24. A pocketed clamp 36 has a pivot pin opening 38 and is received adjacent the handle pivot end 28 of handle half 16, and an apertured clamp 40 having a pivot pin opening 42 is received adjacent the handle pivot end 30 of handle half 18. Additionally, two disk-shaped bearing seals 44 and 46 are positioned adjacent the blade pivot end 24, and they also have pivot pin openings 45 and 47 respectively.

A pivot pin 50 extends through the pivot pin openings 38, 32, 45, 26, 47, 34 and 42 of the pocketed clamp 36, handle half 16, bearing seal 44, blade pivot end 24, bearing seal 46, handle half 18 and apertured clamp 40. The pivot pin 50 is secured by a pivot pin machine screw 52, thereby mounting the blade 14 for pivotal movement on the handle between the closed position shown in FIG. 1 with the blade 14 in the blade slot 20 and the open position shown in FIG. 3 with the blade 14 extending from the handle 12. The pivot pin 50 and machine screw 52 also secure the handle halves 16 and 18 together, and they are additionally secured together by screws 54, 56 and 58.

Figure 3:
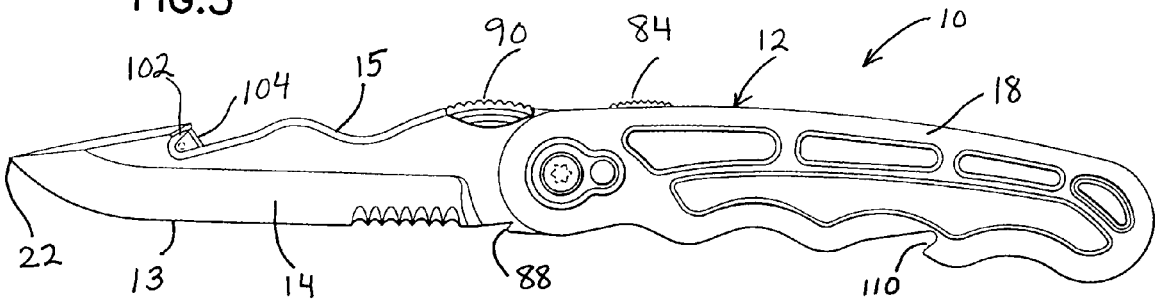
FIG. 3 is a side elevation view of the fishing knife of FIG. 1, shown in its fully opened position.
Figure 4:
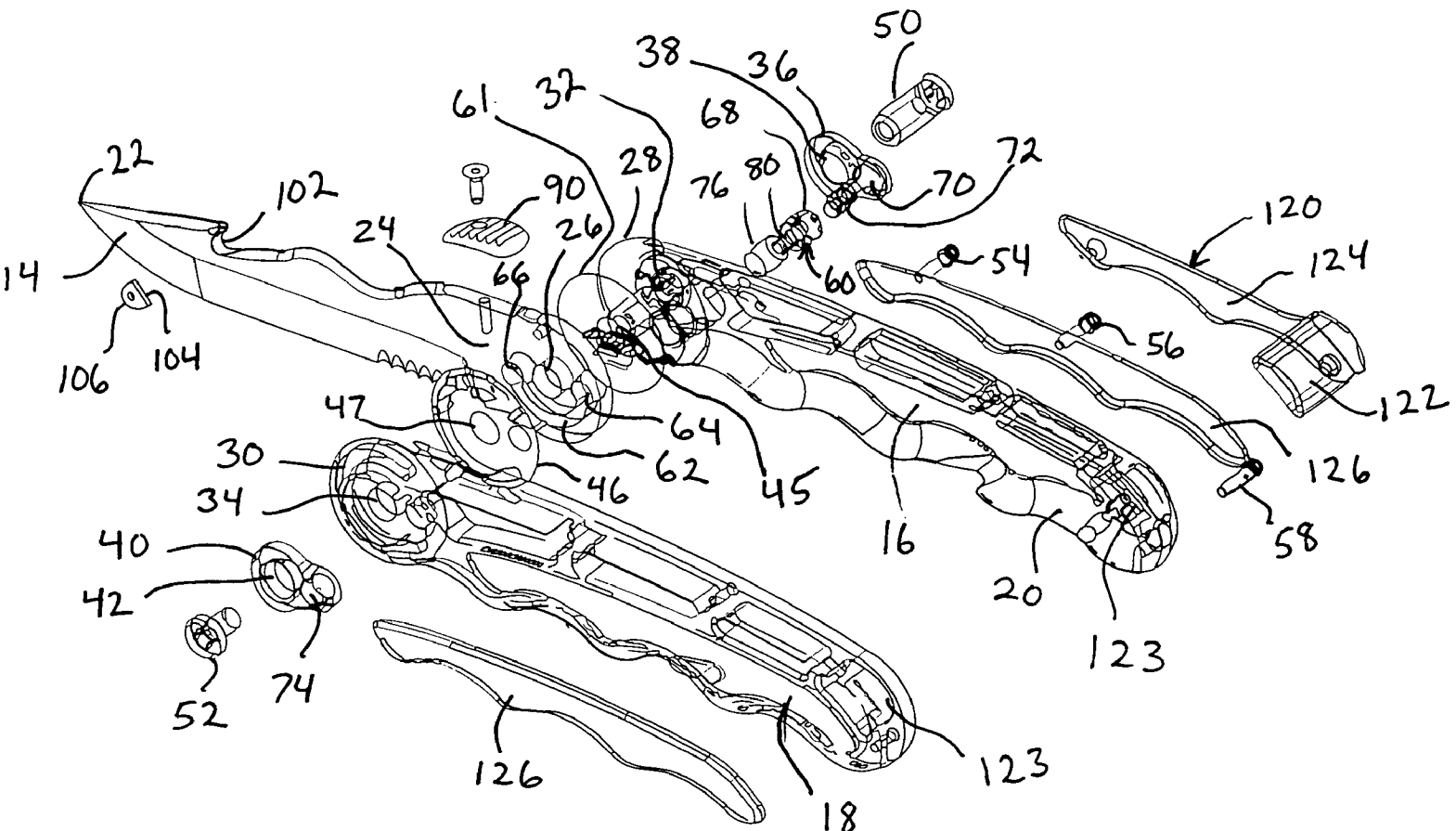
FIG. 4 is an exploded view of the fishing knife of FIG. 1.
Figure 5:
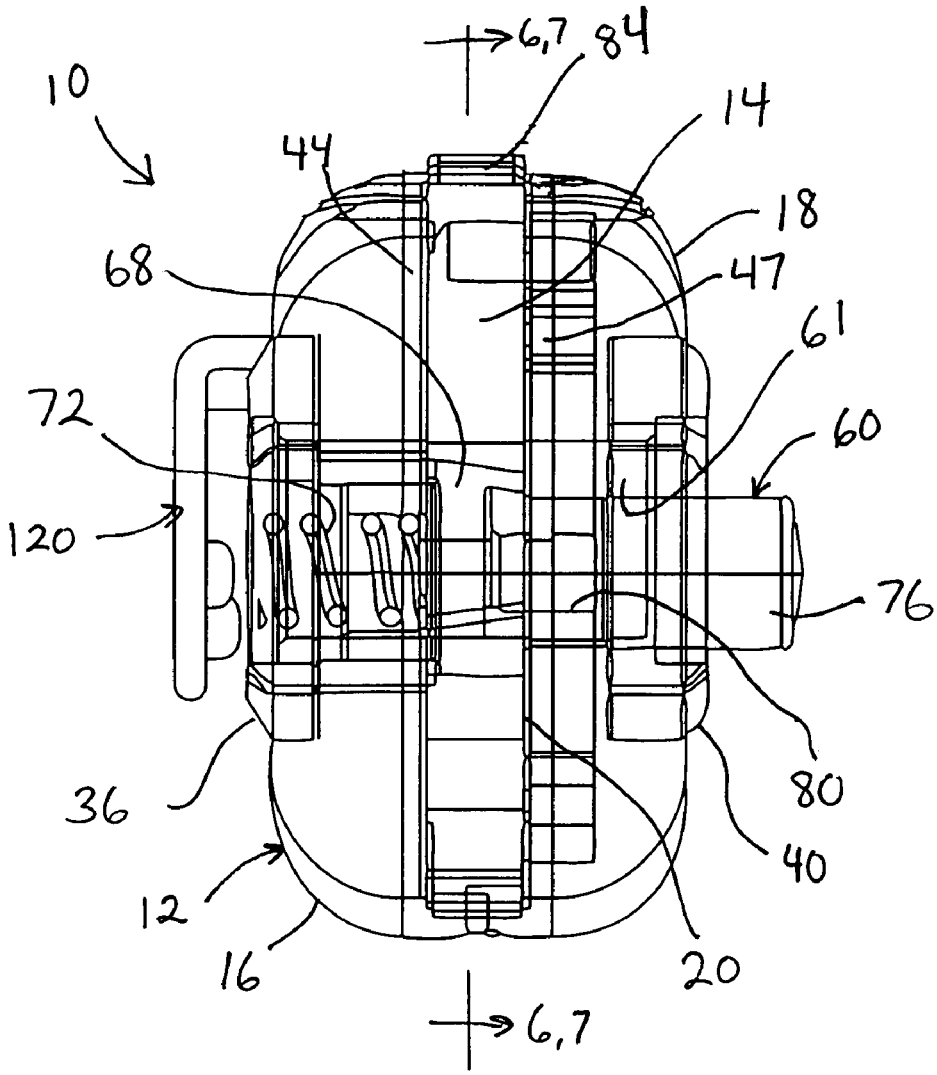
FIG. 5 is a sectional view of the fishing knife of FIG. 1, taken generally along the lines 5-5 of FIG. 1.

The blade 14 is held in and released from the closed and open positions shown in FIGS. 1 and 3, respectively, by a blade lock plunger 60. The blade lock plunger 60 extends through the handle 12 between the pocketed clamp 36 and the apertured clamp 40. Bushings 61 support and guide the blade lock plunger 60. The blade lock plunger 60 also extends through an arcuate pivot slot 62 defined in the blade 14, concentric with the pivot pin opening 26. The arcuate slot 62 has enlarged, round lock ends 64 and 66. The blade lock plunger 60 is stepped, having a locking portion 68 which is snugly accommodated in the round lock ends 64, 66 and a smaller diameter release portion 80 which is accommodated in the arcuate pivot slot 62. The pocketed clamp has a pocket 70 which receives a coil spring 72, for spring biasing the blade lock plunger 60 toward the apertured clamp 40. The apertured clamp has a blade lock plunger aperture 74, and an actuating end 76 of the lock plunger 60 extends through the aperture 74. When the blade lock plunger is in this biased position, the locking portion 68 of the blade lock plunger is seated in one of the round lock end openings 64, 66 of arcuate pivot slot 62, thereby locking the blade 14 in a closed or open position. Depressing the actuating end 76 of the blade lock plunger 60 positions a smaller diameter release portion 80 of the blade lock plunger in the arcuate pivot slot 62, which permits the blade 14 to pivot between closed and open positions with the release portion 80 of the blade lock plunger 60 in the arcuate pivot slot 62.

To provide the fishing knife 10 with additional security in the closed position, an auxiliary blade lock 84 is mounted on the back 21 of the handle 12, the handle back 21 being opposite the blade slot 20. The auxiliary blade lock 84 has a foot 86 that engages a notch 88 in the blade, and can be released by sliding manipulation.

The blade 14 is also provided with a thumb pad 90 mounted to the back 15 or non-sharp side of the edge, near the handle 12. The thumb pad 90 permits the user to exert pressure on the back 15 of the blade 14 to apply more cutting force to the sharp edge 13, and the thumb pad 90 can be engaged with the user's thumb to assist in pivoting the blade, contributing the convenience of more one-hand operation.

Figure 6:
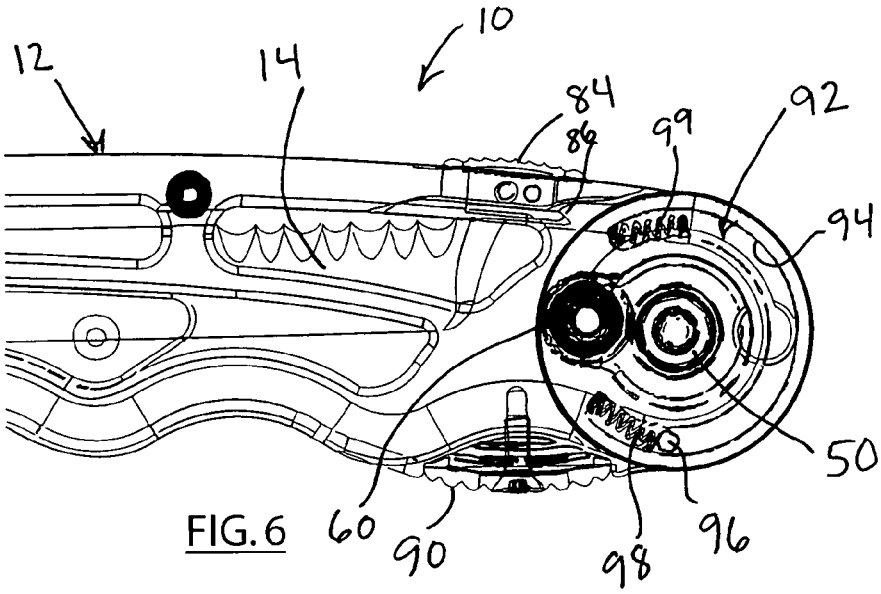
FIG. 6 is a schematic sectional view of the fishing knife of FIG. 1, taken generally along the lines 6-6 of FIG. 5 with the blade closed.
Figure 7:
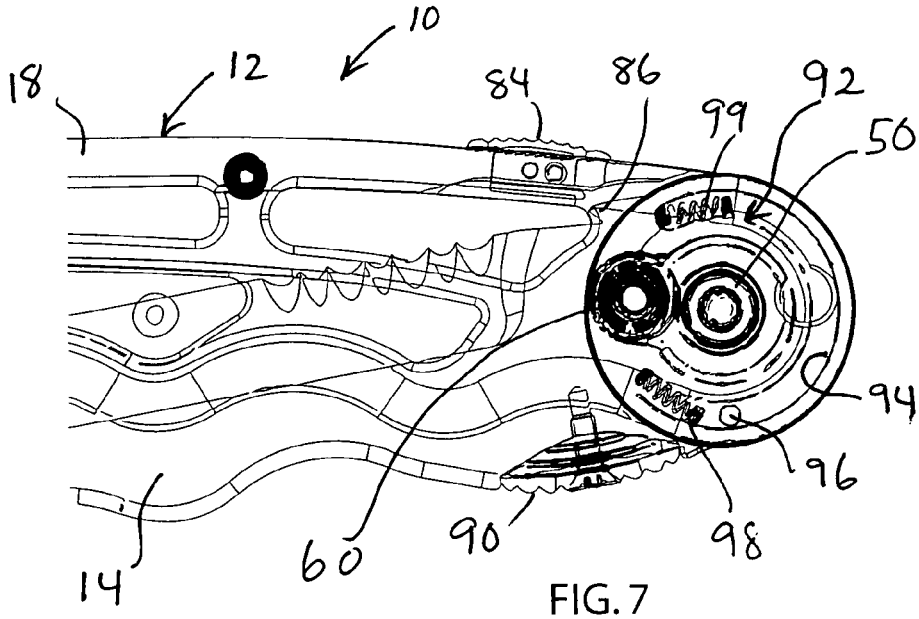
FIG. 7 is a modified sectional view of the fishing knife of FIG. 1, taken generally along the lines 6-6 of FIG. 5, but with the blade in its initially opened position.

The fishing knife 10 is also preferably provided with a blade assist assembly 92, best seen in FIGS. 6 and 7, in which incrementally opens and closes the blade 14 when the blade 14 is released from the closed position and the open position by manipulation of the blade lock plunger 60. The blade assist assembly 92 includes an arcuate blade assist slot 94 in handle half 18, concentric with pivot pin 50, and a blade assist pin 96 extending from the blade 14 into the blade assist slot 94. Blade assist springs 98 and 99 are positioned at the respective ends of the blade assist slot 94. As shown in FIG. 6, the blade assist spring 98 is compressed between the adjacent end of the blade assist slot 94 and the blade assist pin 96 when the blade 14 is in the closed position. As shown in FIG. 7, when the blade 14 is released from the closed position, the blade assist spring 98 provides initial pivoting of the blade 14 toward the open position. This initial pivoting is preferably on the order of 20-30°. The initial pivoting also ensures that the release portion 80 of the blade lock plunger 60 is deployed in the arcuate pivot slot 62 when the blade lock plunger 60 is released, and also brings the thumb pad 90 into better position for the user to engage it and further opening of the knife 10.

Figure 8:
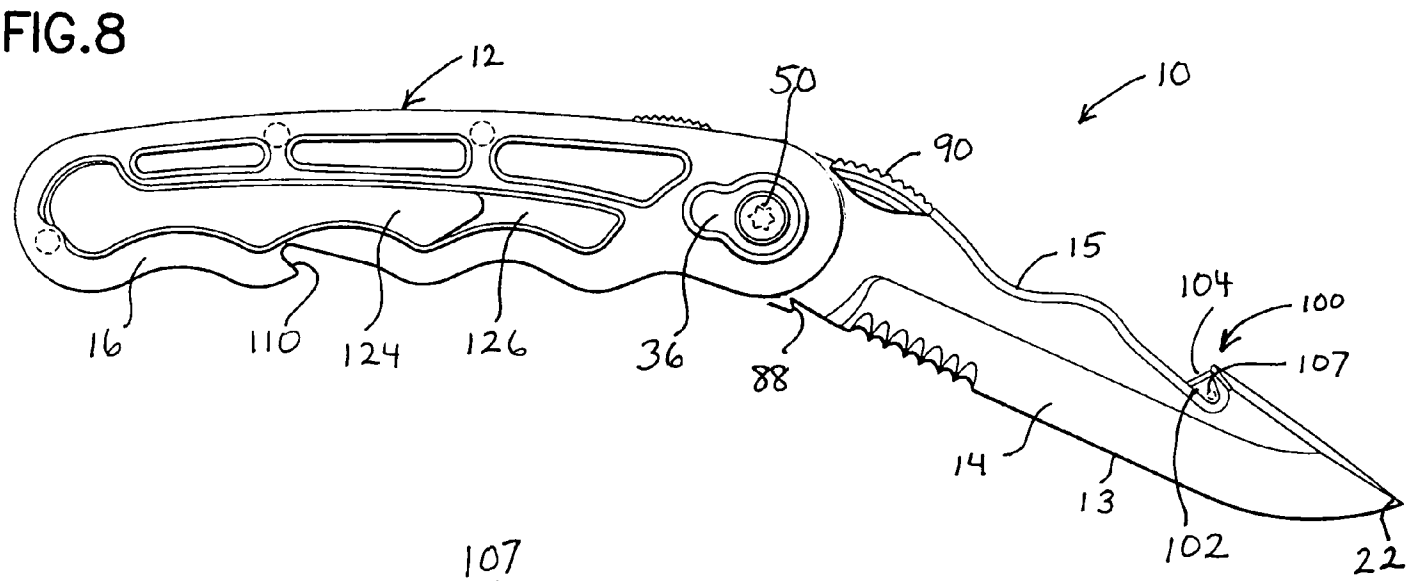
FIG. 8 is a side elevation view of the fishing knife of FIG. 1, shown in its initially closed position.

The blade assist spring 99 is compressed between the other end of the arcuate blade assist slot 94 and the blade assist pin 96 when the blade 14 is open, and upon releasing the blade 14 for closing, the blade assist spring 99 provides the initial closing rotation as shown in FIG. 8. The amount of closure is also on the order of 20-30° and ensures that the release portion 80 of the blade lock plunger 60 is in the arcuate pivot slot 62 when the blade lock plunger 60 is released.

The fishing knife 10 includes a line cutter 100 including a recess 102 formed in blade 14 on the back 15 of the blade opposite the cutting edge 13. The line cutter is shown in detail in FIGS. 9 and 10. The recess 102 is preferably arcuate and disposed toward the handle 12 when the blade 14 is in its open position. The recess 102 is positioned toward the tip 22 of blade 14, about ¼ to ⅓ of the way from the tip 22 to the pivot end 24 of blade 14. A line cutting edge 104 is disposed across the recess 102, such that the recess 102 may be used to capture line for cutting by the line cutting edge 104.

Figure 10:
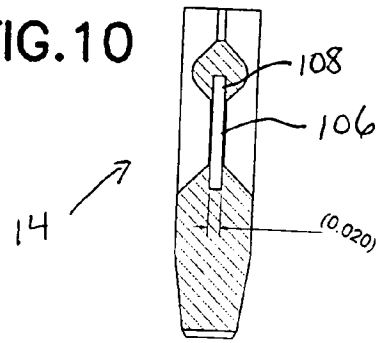
FIG. 10 is a sectional view of the blade of the fishing knife of FIG. 1, taken along the lines 10-10 of FIG. 9.
Figure 9:
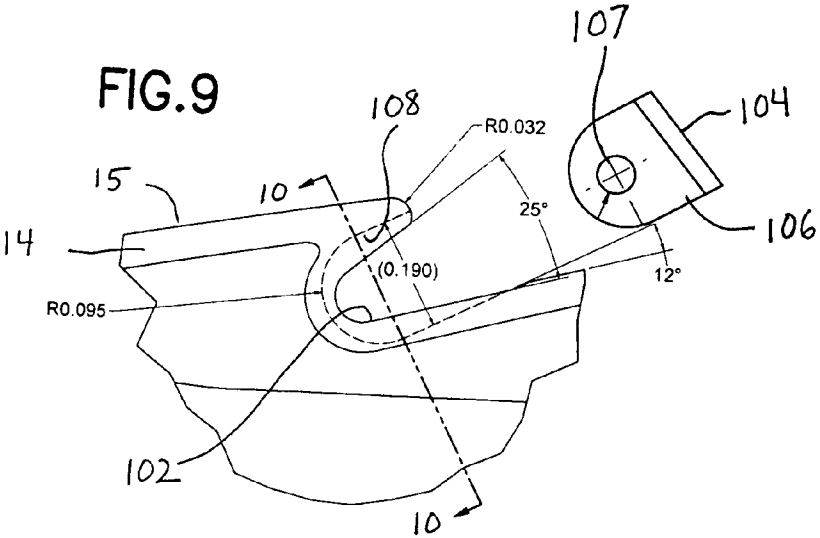
FIG. 9 is an exploded view of a line cutter assembly of the fishing knife of FIG. 1.

As best seen in FIGS. 9 and 10, the line cutting edge 104 is preferably provided on a cutter insert 106 which is received in a matingly configured slot 108 in the blade 14. The cutter insert 106 is replaceable to renew a worn line cutting edge 104. Opening 107 in cutter insert 106 permits the cutter insert 106 to be engaged for removal.

The fishing knife 10 is also configured so that the line cutter 100 is available for use when the blade 14 is in its closed position. The handle 12 defining the blade slot 20 flanks the blade 14 adjacent the recess 102. To this end, the handle 12 defines a recess 110 extending across the blade slot 20, and the recess 102 defined in the blade 14 and the recess 110 defined by the handle 12 are cooperatively aligned so that the blade 14 is completely concealed at the recess 110 except for the line cutter 100 such that the line cutting edge 104 is exposed for cutting a line when the blade 14 is in its closed position, as shown in FIG. 1. This permits use of cutting edge 104 to cut line without taking the time to open the blade 14 of knife 10, and is also a safety feature in that there is no need to expose the sharp edge 13 of blade 14 for the simple task of cutting a line.

The fishing knife 10 is further provided with a belt clip 120, including an anchor end 122 that extends through mating recess 123 in the handle 12 to firmly support the belt clip 120. It has a clip leg 124 that extends along handle half 16 of the handle 12, such that a belt can be received between the clip leg 124 and the handle half 16. Handle trim inserts 126 may be provided on handle halves 16, 18 for appearance sake.

The handle 12 defines openings 130, 132 and 134 along the back of the handle. These openings prevent water and debris, such as sand and fish scales, from accumulating in the blade slot and contribute to the ease of care and longevity of the knife 10.

The knife 10 described above fully satisfies the objects of the invention herein. It will be appreciated that knife 10 and the description thereof are illustrative of the invention and that various modifications can be made without departing from the spirit and scope of the invention, which is limited only by the elements of the following claims and their equivalents.

I claim:

1. A fishing knife comprising:

A) a handle defining a blade slot;

B) a blade pivotally mounted on a pivot pin extending through the handle at one end of the blade slot, the blade being pivotal between a closed position in which the blade is substantially received in the blade slot and an open position extending from the handle, the blade having a tip, a sharp edge extending from the tip, and a back generally opposite the sharp edge; and C) a line cutter including a line cutter recess defined in the back of the blade and a line cutting edge extending across the line cutter recess, wherein the handle defining the blade slot flanks the blade adjacent the line cutter recess and the handle defines an access recess cooperatively configured and aligned with the line cutter recess defined by the blade so that the blade is completely concealed at the access recess except for the line cutter such that the line cutting edge is exposed for cutting a line when the blade is hin its closed position.

2. A fishing knife as defined in claim 1 wherein the line cutter is disposed away from the tip of the blade and toward the handle when the knife is in its open position.

3. A fishing knife as defined in claim 2 wherein the line cutter comprises a replaceable cutter insert received in a matingly configured slot defined by the blade, the replaceable cutter insert including the line cutting edge.

4. A fishing knife as defined in claim 3 wherein the replaceable cutter insert defines an opening exposed when the replaceable cutter insert is received in the matingly configured slot, the opening providing for engaging the replaceable cutter insert to facilitate insertion and removal thereof.

5. A fishing knife as defined in claim 4 wherein the replaceable cutter insert received in the matingly configured slot defined by the blade is held there by friction fit.

6. A fishing knife as defined in claim 1 wherein the line cutter recess is defined in the blade at a location about ¼ to ⅓ of the distance from the tip of the blade to the pivot pin.

7. A fishing knife comprising:

A) a handle comprising two handle halves defining a blade slot therebetween;

B) a blade pivotally mounted on a pivot pin extending through the handle at one end of the blade slot, the blade being pivotal between a closed position in which the blade is substantially received in the blade slot and an open position extending from the handle, the blade defining an arcuate pivot slot concentric with the pivot pin, the arcuate pivot slot having an enlarged lock opening at each of the respective ends thereof;

C) a blade lock plunger extending across the blade slot and through the arcuate pivot slot in the blade, the blade plunger having a lock portion sized to be closely accommodated in the lock openings of the arcuate pivot slot, the blade lock plunger and the lock openings being positioned for securing the blade in its closed position and in its open position, the blade lock plunger further comprising a smaller release portion positionable in the arcuate pivot slot by axially shifting the blade lock plunger, the release portion permitting the blade to pivot between its open and closed position, the blade lock plunger being spring biased to position the lock portion of the blade lock plunger in the lock openings of the arcuate pivot slot, and the blade lock plunger having an actuating end extending from the handle for manually axially shifting the blade lock plunger by depressing the actuating end;

D) a pocketed clamp positioned against one of the handle halves and defining an opening receiving the pivot pin and a pocket receiving a coil spring for biasing the blade lock plunger; and E) an apertured clamp positioned against the other handle half and having an aperture receiving the pivot pin and an aperture permitting the actuating end of the blade lock plunger to extend from the handle for manipulation, wherein the pivot pin secures the pocketed clamp, the handle halves and the apertured clamp together.

8. A fishing knife as defined in claim 7 wherein two polymer bearing seals are positioned flanking the blade with the pivot pin passing through the bearing seals.

9. A fishing knife as defined in claim 8 and further comprising a thumb pad mounted to the back of the blade and positioned adjacent the handle when the blade is pivoted to its open position.

10. A fishing knife as defined in claim 9 and further comprising:

F) a blade assist assembly spring biasing the blade to a partially opened position when the blade is released from its closed position by shifting of the blade lock plunger.

11. A fishing knife as defined in claim 10 wherein the blade assist assembly spring biases the blade to a partially closed position when released from its open position by shifting of the blade lock plunger.

12. A fishing knife as defined in claim 11 wherein the blade assist assembly comprises an arcuate blade assist slot defined in the handle concentric with the pivot pin and adjacent the blade, a post extending from the blade into the arcuate blade assist slot, and two coil springs respectively positioned at first and second ends of the blade assist slot, whereby the post engages and compresses one of the two coil springs when the blade is in its opened or closed position.

13. A fishing knife as defined in claim 12 and further comprising a blade lock slidingly mounted on the handle and including a foot engageable in a cooperating notch in the blade when the blade is in its closed position, wherein the blade lock is slidable to release the blade for pivoting to its open position.

14. A fishing knife as defined in claim 7 and further comprising a line cutter including a recess defined in the back of the blade and a line cutting edge extending across the recess.

* * * * *